US005151742A

United States Patent [19]

Yamaguchi

[11] Patent Number: 5,151,742

[45] Date of Patent: Sep. 29, 1992

[54] FIXING DEVICE SHEET GUIDE APPARATUS

[75] Inventor: Yasuyoshi Yamaguchi, Shizuoka, Japan

[73] Assignee: Tokyo Electric Co., Ltd., Tokyo, Japan

[21] Appl. No.: 611,294

[22] Filed: Nov. 9, 1990

[30] Foreign Application Priority Data

Nov. 22, 1989 [JP] Japan ..... 1-135613[U]

[51] Int. Cl.[5] ..... G03G 15/20

[52] U.S. Cl. ..... 355/285; 271/3.1; 271/312; 355/321

[58] Field of Search ..... 355/282, 285, 308, 309, 355/318, 321, 283; 271/3, 3.1, 312

[56] References Cited

U.S. PATENT DOCUMENTS

| | | | |
|---|---|---|---|
| 4,332,457 | 6/1982 | Mitsuyama et al. | 355/315 |
| 4,336,992 | 6/1982 | Szulcha et al. | 355/315 X |
| 4,777,498 | 10/1988 | Kasamura et al. | 346/150 |
| 4,945,390 | 7/1990 | Hasegawa et al. | 355/318 X |

FOREIGN PATENT DOCUMENTS

| | | | |
|---|---|---|---|
| 0291943 | 11/1988 | European Pat. Off. . | |
| 3715119 | 12/1987 | Fed. Rep. of Germany . | |
| 0052783 | 5/1981 | Japan | 355/283 |
| 0043677 | 3/1985 | Japan | 355/285 |
| 0276076 | 11/1988 | Japan | 355/285 |

OTHER PUBLICATIONS

Proceedings of the SID, vol. 28/1, 1987, pp. 81-85, Z. K. Kun, et al., "TFEL Edge Emitter Array for Optical Image Bar Applications".

Journal of Imaging Technology, 14, No. 1, Feb. 1988, pp. 12-15, D. Leksell, et al., "Construction and Characterization of 12-In. Long TFEL Edge Emitter Eraser Bar for Electrophotographic Applications".

D. Leksell, et al., 2 pages, "The Construction and Characterization of a 400 Lines-Per-Inch TFEL Edge Emitter".

Z. K. Kun, et al., 8 pages, "Test Station for Thin Film Electroluminescent (TFEL) Edge Emitter Array, A Potential Low-Cost, All Solid State Imaging Device".

SPIE Proceedings, Dec. 16, 1987, pp. 1-16, Z. K. Kun, et al., "Test Station for Thin-Film Electroluminescent (TFEL) Edge Emitter Array: A Potential Low-Cost, All Solid State Imaging Device".

*Primary Examiner*—Joan H. Pendegrass
*Assistant Examiner*—Christopher Horgan
*Attorney, Agent, or Firm*—Oblon, Spivak, McClelland, Maier & Neustadt

[57] ABSTRACT

The present invention relates to a sheet guide apparatus of the type that a recording sheet delivered by a rotary movement in peripheral contact between a fixing roller and a pressure roller drops by its own weight into an upper open-type sheet receiving unit disposed near a sheet delivery side of the pressure roller, and sheet delivery rollers or the like disposed on the sheet delivery side of a fixing apparatus are normally omitted, thereby permitting dimensional reduction of the apparatus and simplicity of its structure.

3 Claims, 4 Drawing Sheets

FIXING DEVICE SHEET GUIDE APPARATUS

BACKGROUND OF THE INVENTION

1. Field of the Invention and Related Art Statement: The present invention relates to a sheet guide apparatus suitable for use in a copying machine a facsimile machine, a printer, etc., and more specifically to a sheet guide apparatus for guiding each of sheets delivered from a fixing apparatus.

FIG. 8 shows a conventional example of this type of apparatus. There is first provided a fixing apparatus 102 having a structure of the type that a rotatable pressure roller 101 is upwardly pressed against a fixing roller 100 driven and rotated by an unillustrated drive unit. At the fixing apparatus 102 having such a structure, each of sheets 103 delivered from an unillustrated photosensitive drum is drawn in between the fixing roller 100 and the pressure roller 101 both of which are being rotated. At this time, the sheet 103 is delivered to a sheet delivery side in a state in which a printed face 103*a* with a toner image transferred thereon is being kept upward. Therefore, the printed face 103*a* is pressed against the fixing roller 100 by the pressure roller 101. As a consequence, the toner image is fixed on the sheet 103 owing to the heat produced by the fixing roller 100.

Then, a scraper 104 is provided on the sheet delivery side of the fixing apparatus 102 such that the distal end thereof is held in contact with an outer peripheral surface of the fixing roller 100. Thus, the sheet 103, which is discharged or delivered from the fixing apparatus 102 and which would otherwise be wound on the fixing roller 100, is scraped from the fixing roller 100 by means of the scraper 104. The sheet 103 thus scraped from the fixing roller 100 is guided between a pair of sheet delivery rollers 106 by a sheet delivery guide plate 105 provided on the sheet delivery side of the fixing apparatus 102 so as to be delivered, so that the sheet 103 is introduced into a sheet receiving unit 107 disposed below the sheet delivery rollers 106.

On the other hand, the sheets 103 thus introduced into the sheet receiving unit 107 are superposed on each other in a state in which each printed face 103 is being kept upward. Thus, when it is desired to print the sheets 103 with pages marked thereon, they are piled up on the sheet receiving unit 107 in reversed page order. Therefore, there is a demand for the delivery of the sheets 103 to the sheet receiving unit 107 in a state in which each printed face 103*a* is being kept downward with a view to superpose the sheets 103 on each other in page order. In order to meet this demand, a sheet changeover plate 108 is provided vertically and turnably on the sheet delivery side of the sheet delivery rollers 106 in the apparatus shown in FIG. 8. There is defined, in an upper portion of the changeover plate 108, a sheet delivery passage 110 adapted to reverse each of the sheets 103 delivered to the sheet delivery rollers 106 into an U-shape for thereby introducing the same into a sheet delivery tray 109 provided above a casing. Accordingly, each of the sheets 103 is selectively delivered to the sheet receiving unit 107 or the sheet delivery tray 109 above the casing according to angular positions of the changeover plate 108, and the sheets 103 are superposed on each other in page order within the sheet delivery tray 109.

A description will next be made of problems in the device referred to above. The sheet delivery guide plate 105 and the pair of sheet delivery rollers 106 are provided between the fixing apparatus 102 and the sheet receiving unit 107 or the sheet delivery passage 110. The conventional apparatus is therefore accompanied by the drawback that the dimension from the fixing apparatus 102 to the entrance of the sheet receiving unit 107 or the sheet delivery passage 110 is increased to produce dimensional enlargement of the sheet guide apparatus and to increase the number of components. In particular, it will be extremely convenient because the dimensional enlargement of the sheet guide apparatus causes machines such as copying machines in which the sheet guide apparatus is employed to be large in size.

In addition, components required to guide and carry each of the sheets 103 are essential for the delivery of the sheets 103. However, they can jam the sheets 103. The provision of such components is therefore accompanied by the drawback that the sheets 103 are jammed in the sheet delivery guide plate 105 or between the sheet delivery rollers 106.

The conventional apparatus is further provided with an unillustrated cleaner for removing any toner adhered to the fixing roller 100. However, there are some cases where the toner adhered to the fixing roller 100 cannot completely be removed according to the type of the cleaner. As a consequence, the remaining toner may be adhered to the pressure roller 101. In this case, the adhesion of the toner thereto results in the drawback that the reverse side of each sheet 103 is stained with the toner.

OBJECT AND SUMMARY OF THE INVENTION

A first object of this invention is to provide a sheet guide apparatus which can contribute to dimensional reduction of a machine in which the sheet guide apparatus is employed.

A second object of this invention is to provide a sheet guide apparatus of the type that the number of its components is reduced and its structure is simplified.

A third object of this invention is to provide a sheet guide apparatus capable of reducing the occurrence of a jam.

A fourth object of this invention is to provide a sheet guide apparatus capable of preventing a stain on a sheet caused by a fixing apparatus.

In order to achieve the above objects, there is provided a sheet guide apparatus according to this invention, which comprises a rotatable fixing roller having heating means, a rotatable pressure roller adapted to be pressed upwardly against the fixing roller and a sheet receiving unit having an open top and a bottom face thereof extending in a direction in which a sheet is to be delivered and having a substantially vertically extending rear end face thereof at a position closer to the center of rotation of the pressure roller than a vertically-extending tangential line to the outer peripheral surface of the pressure roller on a sheet delivery side thereof. Accordingly, each of the sheets, which has passed through the fixing roller and the pressure roller, is introduced into the sheet delivery guide plate and the sheet delivery rollers are omitted and hence its dimensional reduction is made correspondingly, thereby permitting a contribution to a decrease in size of a machine such as a copying machine in which the sheet guide apparatus is employed. Further, the structure of the machine is also simplified and the number of its components is reduced. Furthermore, the sheets are also prevented from being jammed.

BRIEF DESCRIPTION OF THE DRAWINGS

The above and other objects, features and advantages of the invention will become apparent from reading the following description of the preferred embodiments taken in connection with the accompanying drawings in which.

DETAILED DESCRIPTION OF THE PREFERRED EMBODIMENTS

Figure 1:
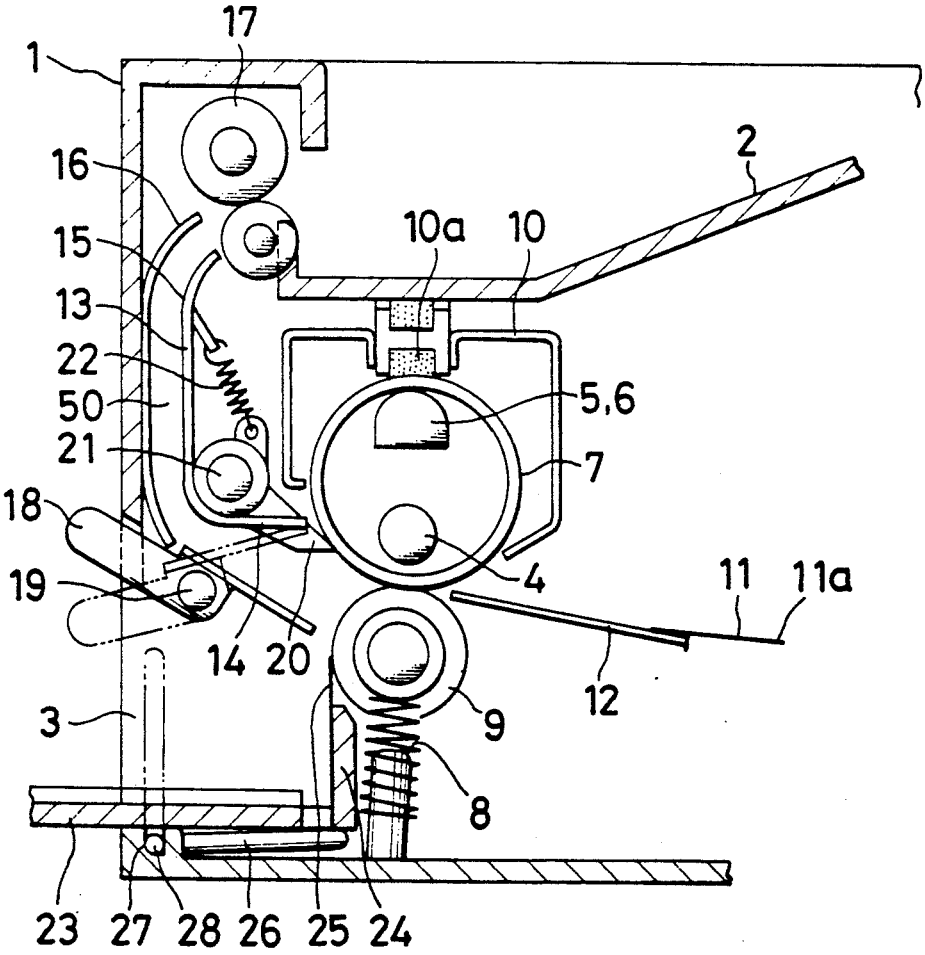
FIG. 1 is a longitudinal cross-sectional and side view showing a first embodiment according to this invention.

One embodiment of the present invention will now be described with reference to FIGS. 1 through 5. The present embodiment shows one example of a sheet guide apparatus employed in a laser printer. FIG. 1 is a longitudinal cross-sectional and side view showing a peripheral portion of a fixing apparatus. In the drawing, designated at numeral 1 is a casing used for the laser printer. The casing 1 has a sheet discharge or delivery tray 2 formed on a upper portion thereof and a transversely-long opening 3 defined in a side wall thereof.

In addition, a fixing roller 7 with a heater 4, a thermostat 5 and a thermistor 6 incorporated therein, and a pressure roller 9 urged upwardly by means of a spring 8 so as to be pressed against the fixing roller 7, are rotatably mounted in the casing 1. The casing 1 has a cover 10 for covering both sides and the upper portion of the fixing roller 7. A cleaning pad 10*a* to be brought into contact with the fixing roller 7 is held by the cover 10. Further, a sheet guide plate 12 for guiding a sheet 11 delivered by a rotary movement in peripheral contact between a photosensitive drum and a transfer press, both of which are positioned on a sheet feed side and are not shown, is provided near a position where the fixing roller 7 and the pressure roller 9 are brought into contact with each other.

Then, a sheet delivery guide plate 13 is provided near a sheet delivery side of a position where the fixing roller 7 and the pressure roller 9 are brought into contact with each other. The sheet delivery guide plate 13 has a guide face 14 extending in a direction in which a sheet is to be discharged or delivered, and another guide face 15 bent upwardly from the guide face 14 and extending upwardly at right angles. The casing 1 has an inner wall thereof at which a sheet delivery guide plate 16 provided in an opposing relationship with the guide face 15 with a predetermined interval defined therebetween is fixed. Thus, a predetermined interval is defined between the sheet delivery guide plates 13 and 16 and is used as a sheet delivery passage 50. On the other hand, the sheet delivery passage 50 has an upper portion thereof which communicates with a pair of rotatable sheet delivery rollers 17 which is in communication with the sheet delivery tray 2. In addition, a sheet changeover plate 18 for introducing the sheet 11 into the opening 3 or the sheet delivery passage 50 is turnably mounted about a shaft 19 below the sheet delivery passage 50.

Then, a scraper 20 whose distal end comes into contact with the outer peripheral surface of the fixing roller 7 is provided near the sheet delivery side of the position where the fixing roller 7 is brought into contact with the pressure roller 9. The scraper 20 is turnably supported on the sheet delivery guide plate 13 via a shaft 21. The distal end of the scraper 20 is urged by means of a spring 22 in a direction in which it is brought into contact with the fixing roller 7.

In addition, a tray 23 as a sheet delivery unit is detachably mounted in the opening 3. A vertical rear end face 24 of the tray 23 is held in alignment with a vertically-extending tangential line to the outer peripheral surface of the pressure roller 9 on the sheet delivery side thereof or located at a position where the end face 24 is closer to the center of rotation of the pressure roller 9 than is the line. In addition, a resilient leaf 25 held in sliding contact with the outer peripheral surface of the pressure roller 9 is fixed to the rear end face 24 of the tray 23.

Figure 2:
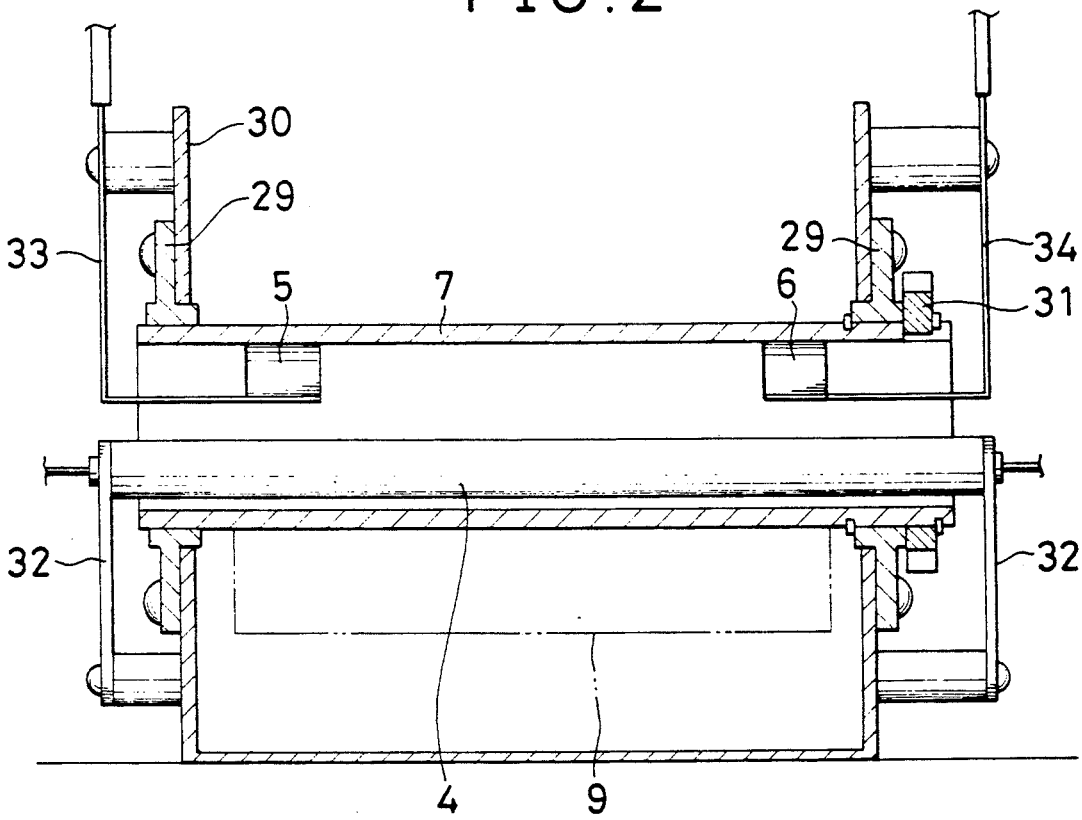
FIG. 2 is a longitudinal cross-sectional and front view illustrating a structure for mounting a fixing apparatus thereon.

A description will now be made of a structure for supporting the fixing roller 7 thereon with reference to FIG. 2. Bearings 29 for rotatably supporting both ends thereon are securely fixed to both sides of a frame 30. A gear 31 driven by an unillustrated motor is fixed to one of the ends of the fixing roller 7. Further, a support plate 32 for supporting both ends of the heater 4, a connecting board 33 for connecting the thermostat 5 to an unillustrated control circuit and a connecting board 34 for connecting the thermistor 6 to the unillustrated control circuit are securely fixed to both sides of the frame 30.

Figure 3:
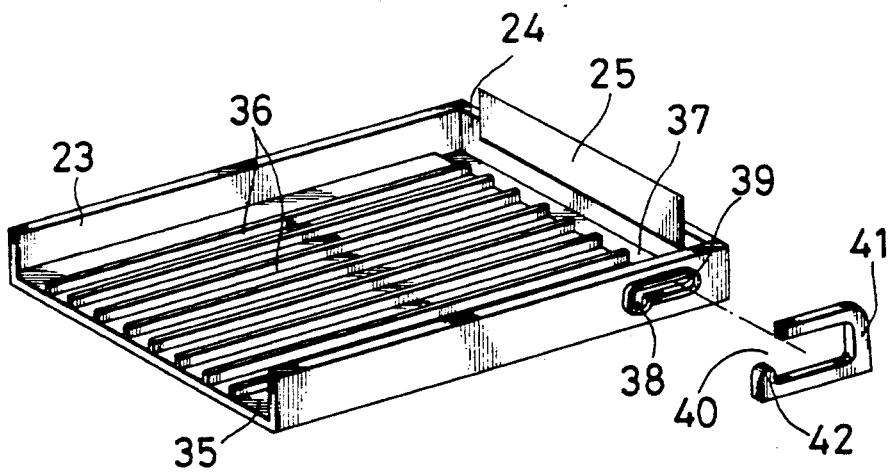
FIG. 3 is a perspective view of a tray.
Figure 4:
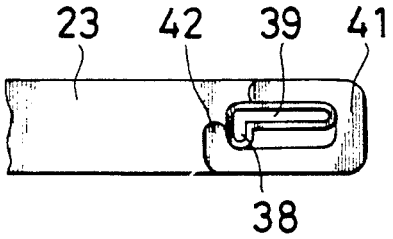
FIG. 4 is an exploded perspective view depicting a structure for supporting the tray thereon.

Then, FIG. 3 show a structure for supporting the tray 23 thereon. The tray 23 has a plurality of protrusions 36 formed on a bottom face 35 thereof and provided side by side along the direction in which the sheet 11 is discharged or delivered. The tray 23 also has a transversely-long slit 37 defined between a rear edge of the bottom face 35 and the rear face 24. The tray 23 has a rib 39 formed integrally in both sides of the rear portion of the tray 23 and having a semicircular protrusion 38 extending downwardly from one end on both sides thereof, which one end is positioned in front of the rear end face 24. Further, each of inverted U-shaped holding members 41 having an opening 40 defined in the one end referred to above is fixedly mounted on one of the two sides of the opening 3 defined in the casing 1. An upwardly-extending semicircular protrusion 42 is formed integrally with the holding member 41 below the opening 40 of the holding member 41. Thus, the respective portions of the above structure are formed such that the protrusions 38 and 42 are held in engagement with each other by inserting the rib 39 into the opening 40 of the holding member 41 as shown in FIG. 4 in a state in which the tray 23 is inclined at a rearwardly-lowered position, thus maintaining the tray 23 in a state in which it is prevented from being released.

Figure 5:
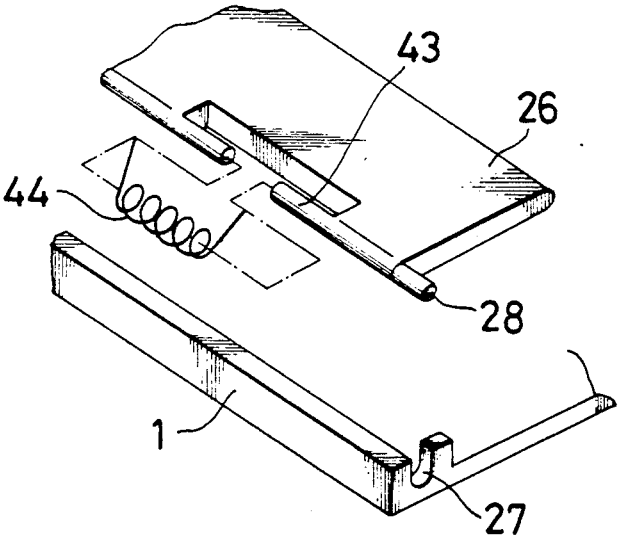
FIG. 5 is an exploded perspective view illustrating a structure for supporting a covering plate thereon.

As shown in FIG. 1, the covering plate 26 for performing the opening/closing of the opening 3 is interposed between the bottom of the casing 1 and the tray 23 in a state in which the tray 23 is held by the casing 1. More specifically, protrusions 28, which are rotatably supported on U-shaped recesses 27 defined in the casing 1, are formed integrally, in both sides of the covering plate 26, with the covering plate 26. As shown in FIG. 5, spring hangers 43 are formed in both sides of the covering plate 26, and supports torsion springs 44 for urging the covering plate 26 in an upward direction.

In the above-described arrangement, the sheet 11 on which an toner image on the photosensitive drum is transferred is guided along the sheet guide plate 12 and then interposed between the fixing roller 7 and the pressure roller 9, thereby transmitting the same to the sheet delivery side. Since the sheet 11 is carried in a state in which a printed face 11*a* having the toner image transferred thereon is being kept upward at this time, the printed face 11*a* is brought into direct contact with the fixing roller 7. Accordingly, an image transferred thereon in a process in which it is interposed between the fixing roller 7 and the pressure roller 9 and then delivered to the sheet delivery side is fixed on the sheet 11. In addition, the sheet 11, which would otherwise be wound on the fixing roller 7, is scraped from the fixing roller 7 by means of the scraper 20.

The sheet 11 is now directed to the upward direction owing to the action of the lower face of the scraper 20 and the upper face of the guide face 14 or the changeover plate 18 in a state in which the changeover plate 18 is inclined in the direction indicated by the solid line in FIG. 1. Thereafter, the sheet 11 is guided into the sheet delivery passage 50 to be introduced into the sheet delivery tray 2. The sheet 11 is held within the tray 2 in a state in which the printed face 11*a* thereof is being kept downward. Accordingly, when the sheets 11 with pages marked thereon are successively piled up on the sheet delivery tray 2, the sheets 11 are put thereon in page order.

On the other hand, the sheet 11, subsequent to fixing of the image thereon, is introduced into the tray 23 by the action of the lower face of the changeover plate 18 in a state in which the changeover plate 18 is at the inclined position indicated by the imaginary line in FIG. 1. Namely, the rear edge of the sheet 11, which is away from the outer peripheral surface of the fixing roller 7 or the pressure roller 9, is introduced into the tray 23 along the resilient leaf 25 securely fixed to the rear end face 24 of the tray 23. At this time, the resilient leaf 25 is brought into contact with the pressure roller 9. Therefore, the sheet 11 taken off after fixing of the image thereon is smoothly introduced into the tray 23. Even when the resilient leaf 25 is not provided, this sheet 11 is introduced into the tray 23 without fail provided that the vertical rear end face 24 of the tray 23 is disposed at a position where it is closer to the center of the pressure roller 9 than a vertically-extending tangential line to the outer peripheral surface of the pressure roller 9 on the sheet delivery side thereof. Contrary to this, so long as the resilient leaf 25 whose upper edge is held in contact with the pressure roller 9 is provided on the sheet delivery side of the pressure roller 9 and the rear end of the tray 23 is connected with the resilient leaf 25, it is unnecessary to dispose the rear end face 24 of the tray 23 at the position where it is closer to the center of the pressure roller 9 vertically-extending tangential line to the outer peripheral surface of the pressure roller 9 on the sheet delivery side thereof.

Figure 8:
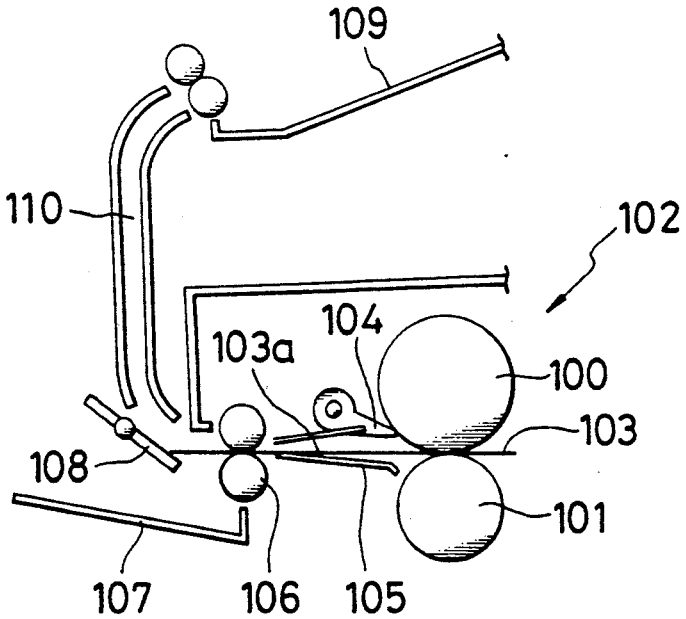
FIG. 8 (PRIOR ART)
FIG. 8 is a side view showing a conventionally-used example.

However, since the sheet 11 referred to above is introduced into the tray 23 as it is, it is unnecessary to dispose the sheet delivery guide plate and the sheet delivery rollers between the pressure roller 9 and the tray 23 as described in the conventional example shown in FIG. 8. In addition, the fixing roller 7 and the pressure roller 9 both serve as sheet delivery rollers. As a consequence, the apparatus is simplified in structure and the number of components is reduced. The dimension from the outer peripheral surface of the pressure roller 9 to the side wall of the casing 1, which is formed on the side of the opening 3, is also reduced and the casing 1 for the laser printer becomes small in size. Further, the sheets 11 are also prevented from being jammed.

The resilient leaf 25 permits prevention of the danger of touching the pressure roller 9 subjected to the heat produced by the fixing roller 7 with the hand upon taking off the sheet 11 from the tray 23. It is also possible to prevent the rear edge of the sheet 11 from being rolled up on the pressure roller 9. Further, since the resilient leaf 25 can suppress the heat produced on or around the periphery of the pressure roller 9 from escaping, it is possible to prevent a failure to fix the image on the sheet 11, which is caused by the fact that temperature on the pressure roller 9 is excessively decreased with respect to the fixing roller 7. Furthermore, the fixing roller 7 is cleaned by the cleaning pad 10*a*. However, the resilient leaf 25 can wipe off foreign particles such as paper dust and toner adhered to the pressure roller 9 by the fixing roller 7. The foreign particles drop into the slit 37 of the tray 23 by the action of wiping-off, so that they are no longer adhered to the bottom face 35 of the tray 23. Even when they are adhered to the tray 23, they fall into spacings defined between each adjacent protrusions 36. Therefore, the reverse side of the sheet 11 in the tray 23 is no longer stained with the foreign particles. In addition, when the tray 23 is released from the casing 1 at the time it is not in use, the covering plate 266 is turned by an urging force of the torsion spring 44 to block the opening 3, thereby making it possible to prevent the danger of touching the pressure roller 9 with the hand.

Incidentally, since the effects for introducing the sheet 11 into the direction in which it is discharged or delivered are exhibited with the help of the lower face of the scraper 20, the guide face 14 may be omitted in practical use.

Figure 6:
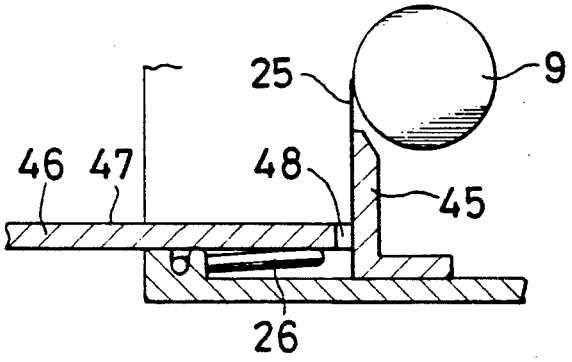
FIG. 6 is a longitudinal cross-sectional and side view depicting a second embodiment according to the invention.
Figure 7:
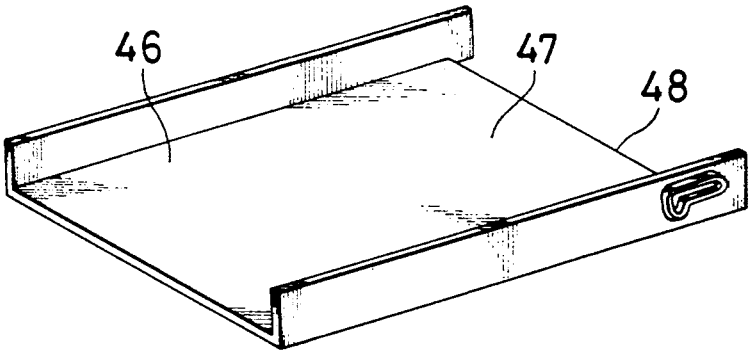
FIG. 7 is a perspective view of a tray employed in the second embodiment.

A second embodiment of this invention will next be described with reference to FIGS. 6 and 7. The same elements of structure as those employed in the first embodiment are identified by like reference numerals and their description will therefore be omitted. In the present embodiment, the resilient leaf 25 is supported on a side wall 45 formed in the casing 1. The rear end face has also been omitted from a tray 46 as a sheet delivery unit. A transversely-long opening 48 is defined between a rear edge of a bottom face 47 of the tray 46 and the resilient leaf 25.

With the above-described arrangement, the rear edge of the sheet 11 away from the outer peripheral surface of the fixing roller 7 or the pressure roller 9 is introduced into the tray 23 along the resilient leaf 25 fixed to the side wall 45 as it is, in a state in which the changeover plate 18 is at a left-lowered inclined position indicated by the imaginary line in FIG. 1.

Further, since the tray 46 has the opening 48 defined therein, foreign particles such as toner, etc., which drop from the pressure roller 9, pass through the opening 48, so that they are prevented from being adhered to the bottom face 47 of the tray 46.

Having now fully described the invention, it will be apparent to those skilled in the art that many changes and modifications can be made without departing from the spirit or scope of the invention as set forth herein.

What is claimed is:

1. A sheet guide apparatus comprising:

a rotatable fixing roller heating means;

a rotatable pressure roller pressed upwardly against said fixing roller so that a sheet may be ejected from between said fixing roller and said pressure roller; and a sheet receiving unit for receiving an ejected sheet, said sheet receiving unit having an open top and having a substantially vertically extending rear end face at a position closer to a center of rotation of said pressure roller than is a vertically-extending tangential line to an outer peripheral surface of said pressure roller on a sheet delivery side thereof, and having a bottom face extending in a direction in which a sheet is to be delivered.

2. A sheet guide apparatus according to claim 1, including a sheet delivery passage having a lower end opened toward a position on the sheet delivery side where said fixing roller is brought into contact with said pressure roller and an upper end opened toward a sheet delivery tray, and further including a pivoting sheet changeover plate disposed below the sheet delivery passage and having an end extending toward one of the outer peripheral surface of said fixing roller or said pressure roller due to the pivoting of said sheet changeover plate.

3. A sheet guide apparatus comprising:

a rotatable fixing roller having heating means;

a rotatable pressure roller pressed upwardly against said fixing roller so that a sheet may be ejected from between said fixing roller and said pressure roller;

a substantially vertically extending resilient leaf having an upper edge thereof brought into contact with the outer peripheral surface of said pressure roller on the sheet delivery side and extending downwardly; and a sheet receiving unit for receiving an ejected sheet, said sheet receiving unit having an open top and having a rear end connected to a lower portion of said resilient leaf and having a bottom face extending in a direction in which a sheet is to be delivered.

* * * * *